US008662778B2

(12) United States Patent
Crawford et al.

(10) Patent No.: US 8,662,778 B2
(45) Date of Patent: Mar. 4, 2014

(54) FLOOR FINISH APPLICATION ASSEMBLY AND METHOD

(75) Inventors: Charles A. Crawford, Racine, WI (US); Andrew M. Bober, Racine, WI (US); Shwn-meei Y. Linden, Racine, WI (US); Christopher F. Lang, Racine, WI (US); Axel Schmitz, Gommiswald (CH); Alfred Adolf Widmer, Wil (CH)

(73) Assignee: Diversey, Inc., Sturtevant, WI (US)

( * ) Notice: Subject to any disclaimer, the term of this patent is extended or adjusted under 35 U.S.C. 154(b) by 0 days.

(21) Appl. No.: 13/482,934

(22) Filed: May 29, 2012

(65) Prior Publication Data

US 2012/0269567 A1 Oct. 25, 2012

Related U.S. Application Data

(63) Continuation of application No. 12/520,184, filed as application No. PCT/US2007/088326 on Dec. 20, 2007, now abandoned.

(60) Provisional application No. 60/871,295, filed on Dec. 21, 2006.

(51) Int. Cl.
*A47L 13/26* (2006.01)

(52) U.S. Cl.
USPC ..... 401/139; 401/27

(58) Field of Classification Search
USPC ..... 401/25, 27, 139; 15/228; 427/355
See application file for complete search history.

(56) References Cited

U.S. PATENT DOCUMENTS 1,135,616 A * 4/1915 Reller ..... 401/205
1,169,958 A * 2/1916 Hurt ..... 15/118
4,961,243 A 10/1990 Barber
4,991,250 A * 2/1991 Young ..... 15/228
5,839,147 A * 11/1998 Chia-Yi et al. ..... 15/228
5,943,727 A * 8/1999 Freer ..... 15/228
6,101,661 A 8/2000 Policicchio et al.

(Continued)

FOREIGN PATENT DOCUMENTS

DE 2932110 2/1981
JP 56104443 8/1981

(Continued)

OTHER PUBLICATIONS

The International Search Report prepared by the Korean Intellectual Property Office for Application No. PCT/US2007/088326 dated Jul. 15, 2008.

*Primary Examiner* — David J. Walczak
*Assistant Examiner* — Bradley Oliver
(74) *Attorney, Agent, or Firm* — Michael Best & Friedrich LLP

(57) ABSTRACT

A floor finish application tool and method for applying floor finishes to a floor. Some embodiments are provided with disposable or quickly replaceable features, such as feed lines or reservoirs to eliminate the need for time consuming clean-up operations. Some embodiments are provided with a two portion hinged head having a spreading or distributing portion and a leveling portion to provide substantially uniform floor finish thickness across a floor. Some embodiments also feature an applicator pad composed of at least two different types of material. The first material is a floor finish distributing material that serves a function of substantially uniformly spreading bulk floor finish across a floor. The second material is a floor finish finishing material that is suitable for leveling the already spread floor finish.

16 Claims, 7 Drawing Sheets

(56) References Cited

U.S. PATENT DOCUMENTS

| | | | | |
|---|---|---|---|---|
| 6,540,424 | B1 | 4/2003 | Hall et al. | |
| 6,571,418 | B2 * | 6/2003 | Slager, Sr. | 15/118 |
| 6,588,956 | B1 * | 7/2003 | Gennuso, Jr. | 401/23 |
| 6,612,768 | B2 * | 9/2003 | Zorzo | 401/138 |
| 6,655,866 | B1 | 12/2003 | Morad et al. | |
| 7,096,531 | B2 * | 8/2006 | Policicchio | 15/228 |
| 2002/0186996 | A1 | 12/2002 | Miller | |
| 2006/0085935 | A1 * | 4/2006 | White | 15/228 |
| 2009/0158544 | A1 * | 6/2009 | Pagani | 15/228 |
| 2012/0060312 | A1 * | 3/2012 | Kubes | 15/228 |

FOREIGN PATENT DOCUMENTS

| | | |
|---|---|---|
| JP | 2001511383 | 8/2001 |
| JP | 2004242800 | 9/2004 |
| JP | 3108311 | 4/2005 |
| JP | 2006516423 | 7/2006 |
| KR | 20-0357758 | 7/2004 |
| KR | 100568163 | 4/2006 |
| WO | 9633649 | 4/1996 |

* cited by examiner

FLOOR FINISH APPLICATION ASSEMBLY AND METHOD

CROSS-REFERENCE TO RELATED APPLICATIONS

This application is a continuation of U.S. patent application Ser. No. 12/520,184, filed Jul. 15, 2009, which is a U.S. national phase application filing of International Patent Application No. PCT/US2007/088326, filed Dec. 20, 2007, which claims the benefit of and priority to U.S. Provisional Patent Application No. 60/871,295, filed Dec. 21, 2006, the entire contents of each of which are incorporated herein by reference.

BACKGROUND OF THE INVENTION

Mop-like assemblies of the type used for applying floor finishes (e.g., floor wax, polyurethane, or other floor finishing or floor sealing materials, etc.) to a surface such as the surface of a floor are well known, and are herein after generally referred to as floor finish application tools or assemblies. Some conventional floor finish application tools generally include a floor finish application head and a handle pivotally attached to the head. A valve assembly is mounted on the handle adjacent the head and in fluid communication with the floor finish to control the flow of floor finish from a reservoir to the floor. The valve is normally closed to stop the flow of floor finish through the valve but can be manually opened to allow the floor finish to flow through the valve to be deposited on the floor at a position close to the head. The floor finish is spread over the surface by the head, or more specifically, by an applicator pad coupled to the head.

While such assemblies can be used effectively if they are thoroughly cleaned between each use, a significant problem can occur if the floor finish is allowed to remain in the valve assembly between uses. Such liquids can thicken and/or solidify when exposed to the atmosphere through the outlet opening of the valve, causing the valve to become sticky or even plugged because of the thickened or solidified material. This presents a difficult and time consuming situation requiring cleaning before the liquid delivery system on the tool will again operate properly.

Additionally, these conventional assemblies generally do not accurately control the amount of floor finish applied to a floor. In other words, these devices generally do not provide a consistent, uniform layer of floor finish across the entire floor. Rather, the floor finish thickness is generally dependent upon the amount of floor finish applied and more specifically the pressure applied to the head via the handle. Without the ability to provide a uniform floor finish thickness, floor finish may be wasted and the floor may not have a uniform appearance or protection (e.g., gloss, scuff resistance, etc.) without the addition of more layers of floor finish.

SUMMARY OF THE INVENTION

The present invention relates to a floor finish application tool for applying floor finishes to a floor. Some embodiments are provided with disposable or quickly replaceable features, such as feed lines or reservoirs, to eliminate the need for time consuming clean-up operations. Some embodiments are provided with a hinged or articulated head having a spreading or distributing portion and a leveling portion to provide substantially uniform floor finish thickness across a floor.

Some embodiments also feature a unique floor finish applicator pad that is useful for applying floor finishing compositions onto a substrate surface such as a floor. The applicator pad of the invention may be composed of at least two different types of material The first material is a floor finish distributing material that helps provide compressive strength to the applicator pad and serve a function of substantially uniformly spreading bulk floor finish across a floor. The floor finish distributing material can be composed of, for example, stiff fibers, large denier fibers, or an open non-woven three-dimensional web fanned of interlaced randomly extending flexible fibers, wherein the interstices between adjacent fibers are open thereby creating a tri-dimensionally extending network of intercommunicated voids. The second material is an floor finish finishing material that is typically composed of adsorbent or small denier fibers, such as microfibers, that are suitable for leveling the already spread floor finish (by the first material) resulting in a smooth, even coating that is substantially free of application marks, such as streaks, brush marks, or other marks left as a result of applying a floor finish.

Some embodiments of the present invention provide a floor finish application tool for applying a floor finish to a floor. The floor finish application tool comprises a floor finish application head, an elongate handle having a first end pivotally attached to the head and a second end opposite the first end, wherein the second end is manually engagable to move the head along the floor. The floor finish application tool also comprises a valve assembly coupled to the handle adjacent the first end of the handle. The valve defining an opening and having a member movable within the opening between a closed position to stop the flow of floor finish through the valve and an open position allowing the flow of floor finish through the valve. The floor finish application tool also comprises a reservoir containing floor finish selectively supported on the handle above the valve assembly, and a length of tubing coupled to the reservoir and extending toward the head for conveying floor finish from the reservoir to the floor. The tubing extends through the opening in the valve assembly and can be selectively resiliently compressed by the valve member. The valve member presses together opposite sides of the length of tubing in the closed position to stop flow of floor finish through the length of tubing. The opposite sides of the tubing resiliently expand when the valve member is in the open position to afford separation of the opposite sides of the length of tubing and flow of floor finish through the length of tubing. The reservoir and tubing are removed from the floor finish application tool and replaced when the floor finish within the reservoir is depleted. Some embodiments also include a sleeve coupled to the handle, wherein the sleeve shaped and configured to receive at least a portion of the reservoir and selectively couple the reservoir to the handle.

In another particular embodiment, the floor finish application tool comprises a handle having a proximal end and a distal end, an actuator coupled to the handle, and a valve coupled to the handle adjacent the distal end of the handle and coupled to the actuator, wherein manipulation of the actuator selectively actuates the valve. The tool also comprises a head coupled to the distal end of the handle and further comprising a mechanical secure for retaining a removable floor finish applicator pad. The tool also comprises a housing for receiving a replaceable floor finish reservoir coupled to the handle, and a replaceable floor finish reservoir adapted to be received within the housing, wherein the replaceable floor finish reservoir has a conduit coupled to an opening of the reservoir and extending away from the reservoir. When the floor finish reservoir is coupled to the housing, the conduit extends through an aperture in the housing and extends through the valve such that actuation of the valve selectively compresses the conduit to prevent floor finish from dispensing from the replaceable floor finish reservoir. The replaceable floor finish reservoir is replaced by removing the conduit from the valve and withdrawing the reservoir and conduit from the housing as a single assembly.

In another particular embodiment, the floor finish application tool comprises a handle and a floor finish application head coupled to the handle. The head includes a first portion adapted to rest adjacent a floor and a second portion adapted to rest adjacent the floor, wherein the first portion is coupled to the handle and the second portion is coupled to the first portion via a hinge member such that the pressure applied to the floor from the second portion is substantially independent from the pressure applied to the first portion via the handle. The floor finish application tool also comprises a floor finish applicator pad coupled to the head and positioned between the first and second portions of the head and the floor. In some embodiments, the tool further comprises a floor finish reservoir coupled to the handle and adapted to deliver floor finish to a floor surface adjacent the head. Some embodiments also include an actuator coupled to the handle and a valve coupled to the handle and coupled to the actuator, wherein manipulation of the actuator selectively actuates the valve. In some embodiments, a housing is coupled to the handle for receiving a replaceable floor finish reservoir and the floor finish reservoir has a conduit coupled to an opening of the reservoir and extending away from the reservoir. The conduit extends through an aperture in the housing and extends through the valve such actuation of the valve selectively compresses the conduit to prevent floor finish from dispensing from the floor finish reservoir. In some embodiments, the floor finish applicator pad further comprises a first material positioned adjacent the first portion of the head and a second material positioned adjacent the second portion of the head. The first material is configured to spread the floor finish and the second material is configured to smooth the floor finish once it has been spread by the first material. The first material can comprise a continuous material having a tri-dimensionally extending network of intercommunicated voids and the second material can comprise a continuous fine fibered fabric. In some embodiments, the first material is a relatively course, open cell material and the second material is a relatively soft, fine material. In some embodiments, the first material comprises a floor finish distributing material having stiff fibers and the second material is a floor finish finishing material having adsorbent fibers.

In another particular embodiment, the floor finish application tool comprises a handle, a floor finish application head attached to an end of the handle, and an applicator pad coupled to the head and comprising a floor finish distributing material and an floor finish finishing material, wherein the floor finish distributing material is coupled to and supported under the head, and wherein the floor finish finishing material is positioned adjacent the floor finish distributing material and a substantial portion of the floor finish finishing material projects from beneath the head to float freely on the floor to apply a substantially continuous force to the floor regardless of the pressure applied to the head via the handle. The floor finish distributing material includes stiff fibers that substantially prevent compression of applicator pad via a load applied to the head. The floor finish finishing material of some embodiments comprises adsorbent fibers, such as microfibers. In some embodiments, the floor finish distributing material and the floor finish finishing material comprise fibers of the same type of material having different deniers or other physical properties. For example, the floor finish distributing material comprises large denier fibers and the floor finish finishing material comprises small denier fibers. In some embodiments, the floor finish distributing material comprises a material configured to spread the floor finish with minimal drag and the floor finish finishing material comprises a material configured to smooth the floor finish once it has been spread by the floor finish distributing material. In some embodiments, the floor finish distributing material is an open cell material and the floor finish finishing material comprises substantially less open cells. Some embodiments also comprise a weighted member positioned adjacent the head and supported adjacent the floor. The weighted member is coupled to the head via a hinge and the weighted member is positioned at least partially on the floor finish finishing material to provide a continuous force against the floor finish finishing material and floor regardless of the force applied to the head via the handle. In some embodiments, a weighed member is positioned adjacent the head and coupled to the floor finish finishing material without any other connection to the head.

In another particular embodiment, the floor finish application tool comprises a handle, a floor finish application head attached to an end of the handle, and an applicator pad comprising a floor finish distributing material and an floor finish finishing material positioned adjacent the floor finish distributing material. The head comprises a main body portion coupled to the handle and a free floating portion coupled to the main body portion via a hinge member, wherein the pressure applied the main body portion via the handle is dependent upon the force applied to the handle by the operator and the pressure applied to the floor from the free floating portion is substantially independent of the force applied to the handle. The floor finish distributing material is coupled to main body portion of the head and the floor finish finishing material is coupled the free floating portion of the head. The floor finish distributing material substantially prevents compression of applicator pad via a load applied to the head and spreads a floor finish substantially evenly across the applicator pad. The floor finish finishing material provides a smooth floor finish coating without leaving undesired streaks or brush mark. In some embodiments, the floor finish finishing material comprises adsorbent fibers, such as microfibers. The floor finish distributing material can be an open cell material and the floor finish finishing material can be a substantially less open celled material.

Some embodiments of the present invention relate to a method of applying a protective floor finish to a floor. The method of one embodiment comprises providing a floor finish application tool described above and actuating the valve assembly from closed position to the open position. The method further comprises dispensing floor finish onto the floor in response to actuating the valve assembly to the open position, spreading the dispensed floor finish across the floor with the head, and removing the reservoir from the handle and the tubing from the valve once the reservoir is empty. The reservoir and the tubing can be removed from the tool as a single assembly. Some embodiments further comprise coupling tubing to a second reservoir, coupling the second reservoir to the handle, extending the tubing through the opening in the valve assembly, actuating the valve assembly from closed position to the open position, dispensing floor finish onto the floor in response to actuating the valve assembly to the open position, and spreading the dispensed floor finish across the floor with the head.

Some embodiments of the present invention are directed a disposable floor finish delivery system. The disposable floor finish delivery system comprises a reservoir containing a floor finish and adapted to be coupled to a floor finish application tool, wherein the reservoir having an opening for selectively dispensing the floor finish and a break-away member providing a vent when the member is broken away from the reservoir. The disposable floor finish delivery system of some embodiments also includes a conduit having a proximal end and a distal end, wherein the proximal end of the conduit is coupled to the opening of the reservoir and the conduit extends away from the reservoir. The distal end of the conduit is sealed, wherein the distal end of the conduit is unsealed once the disposable floor finish delivery system is coupled to a floor finish application tool to allow floor finish to be dispensed. In some embodiments, the conduit is irremovably coupled to the opening of the reservoir. In some embodiments, the reservoir comprises an elongated recess extending the length of the reservoir, wherein the elongated recess is dimensioned and configured to receive a handle of a floor finish application tool and to distribute the weight of the reservoir substantially entirely around the circumference of the handle. The elongated recess can comprise a plurality of projections that extend into the recess to provide an interference fit with the handle. In some embodiments, the center of gravity of the reservoir is positioned within the recess when the reservoir is positioned with the elongated recess in a substantially vertical orientation.

In another embodiment, the disposable floor finish delivery system comprises a reservoir containing a floor finish and adapted to be coupled to a floor finish application tool, wherein the reservoir has an opening for selectively dispensing the floor finish. The disposable floor finish delivery system also comprises a conduit having a proximal end and a distal end, wherein the proximal end of the conduit is irremovably coupled to the opening of the reservoir and the conduit extends away from the reservoir. The distal end of the conduit is sealed, and the distal end of the conduit is unsealed once the disposable floor finish delivery system is coupled to a floor finish application tool to allow floor finish to be dispensed. In some embodiment, the reservoir further comprises a break-away member coupled to the reservoir and providing a vent when the member is broken away from the reservoir. In some embodiments, the reservoir further comprises an elongated recess extending the length of the reservoir, wherein the elongated recess is dimensioned and configured to receive a handle of a floor finish application tool and to distribute the weight of the reservoir substantially entirely around the circumference of the handle.

Some embodiments of the invention are directed toward a reservoir adapted to be received on the handle of a floor tool. The reservoir comprises a plurality of walls defining a substantially enclosed area and an opening is defined in at least one of the plurality of the walls and adapted to be closed by a closure. A longitudinally extending recess is defined in at least one of the walls and is adapted to receive a handle of a floor tool. The reservoir further comprises a center of gravity positioned within the recess when the reservoir is positioned with the longitudinally extending recess in a substantially vertical orientation. As such, the recess is dimensioned and configured to distribute the weight of the reservoir substantially entirely around the circumference of the handle. In some embodiments, the reservoir further comprises a break-away member coupled to the reservoir and providing a vent when the member is broken away from the reservoir. In some embodiments, the recess comprises a plurality of projections that extend into the recess to provide an interference fit with a handle.

Some embodiments are directed toward a floor tool comprising a pad, a head coupled to the pad, a handle coupled to the head, and a reservoir coupled to the handle. The reservoir comprises a plurality of walls defining a substantially enclosed area and an opening is defined in at least one of the plurality of the walls and adapted to be closed by a closure. A longitudinally extending recess is defined in at least one of the walls and is adapted to receive a handle of a floor tool. The reservoir further comprises a center of gravity positioned within the recess when the reservoir is positioned with the longitudinally extending recess in a substantially vertical orientation.

Some embodiments are directed toward a kit for replacing a disposable floor finish delivery system of a floor finish application tool. The kit comprises a reservoir containing a floor finish and adapted to be coupled to a floor finish application tool, wherein the reservoir having an opening for selectively dispensing the floor finish. The kit also comprises a first closure coupled to the opening and selectively removable from the reservoir. The kit also includes a second closure adapted to be irremovably coupled to the opening of the reservoir. The kit also includes a conduit coupled to the second closure. The conduit has a proximal end and a distal end, wherein the proximal end of the conduit is coupled to the second closure. The distal end of the conduit being sealed with a selectively removable seal. During use, the first closure is removed from the reservoir and the second closure is irremovably attached to the reservoir. The distal end of the conduit is unsealed once the reservoir, second closure, and conduit are coupled to a floor finish application tool to allow floor finish to be dispensed. In some embodiments, the kit further comprises a floor finish application pad adapted to be coupled to a floor finish application tool.

Some embodiments of the present invention provide a floor finish application pad. The pad comprising a first portion comprising a first continuous material and a second portion comprising a second continuous material, wherein the second portion positioned adjacent to the first portion. The first continuous material comprises a tri-dimensionally extending network of relatively large intercommunicated voids configured to substantially uniformly spread the floor finish regardless of pressure applied to the first portion. The second continuous material comprises a relatively fine material configured to smooth the floor finish once it has been spread by the first material. In some embodiments, the first continuous material comprises an open cell material, such as open cell foam, sponge, spaced apart brushes, an open cell non-woven material, an open weave material, a needle punch non-woven material and the like. In some embodiments, the second continuous material comprises at least one of a fine fibered woven fabric and a fine fiber non-woven fabric, such as fleece, felt, micro fiber, and terrycloth. In some embodiments, the first continuous material is a relatively course, open cell material and the second continuous material is a relatively soft, fine material. In some embodiments, the first continuous material comprises relatively stiff fibers and the second continuous material comprises adsorbent fibers. The stiff fibers and the adsorbent fibers can comprise fibers of the same type of material having different denier. In some embodiments, the stiff fibers have a large denier relative to the adsorbent fibers. The stiff fibers have one or more of the following properties: a high bending stiffness, high elasticity, low water absorbance, low compressibility, and low flexibility. In some embodiments, the first portion comprises at least a continuous 50% of the pad. In other embodiments, the first portion comprises at least a continuous 60% of the pad. In yet other embodiments, the first portion comprises at least a continuous 70% of the pad. In yet other embodiments, the first portion comprises at least a continuous 75% of the pad. Some embodiments also comprise a third portion positioned adjacent the first portion, wherein the third portion comprises a third continuous material adapted to distribute bulk floor finish from a single position in front of the pad to the outer edges of the pad. In some embodiments, the third continuous material is an absorbent material the third continuous material can be the same material as the second material. In some embodiments, the first portion comprises at least a continuous 50% of the application pad and the third portion comprises less than about a continuous 10% of the application pad.

Some embodiments are directed toward a floor finish application pad comprising a first portion comprising a first continuous material, a second portion comprising a second continuous material, wherein the second portion positioned adjacent to the first portion, and a third portion comprising a third continuous material, wherein the third portion positioned adjacent the first portion opposite the second portion. The first continuous material comprises a tri-dimensionally extending network of relatively large intercommunicated voids configured to substantially uniformly spread the floor finish regardless of pressure applied to the first portion. The second continuous material comprises a relatively fine material configured to smooth the floor finish once it has been spread by the first material. The third continuous material comprises a relatively fine material configured to engage and distribute bulk floor finish across the floor finish application pad. In some embodiments, the first portion comprises at least a continuous 50% of the application pad and the third portion comprises less than about a continuous 10% of the application pad. In some embodiments, the third portion comprises less than about a continuous 5% of the application pad. In some embodiments, the first portion comprises at least a continuous 60% of the application pad. The third continuous material can be the same material as the second material in some embodiments. The first continuous material can be an open cell material and the second continuous material can be at least one of a fine fibered woven fabric and a fine fiber non-woven fabric.

Some embodiments are directed toward a floor finish application pad comprising a first continuous material comprising less than about 10% of the pad, a second continuous material positioned adjacent to the first continuous material and comprising at least 50% of the pad, and a third continuous material positioned adjacent the second continuous material. The first continuous material is configured to engage and distribute bulk floor finish across floor finish application pad. The second continuous material is configured to substantially uniformly spread the floor finish. The third continuous material is configured to smooth the floor finish once it has been spread by the first material. The second continuous material can be a tri-dimensionally extending network of relatively large intercommunicated voids or an open cell material. In some embodiments, the first continuous material is the same material as the third continuous material. The first continuous material can he an absorbent material.

Further aspects of the present invention, together with the organization and operation thereof, will become apparent from the following detailed description of the invention when taken in conjunction with the accompanying drawings.

Figure 1:
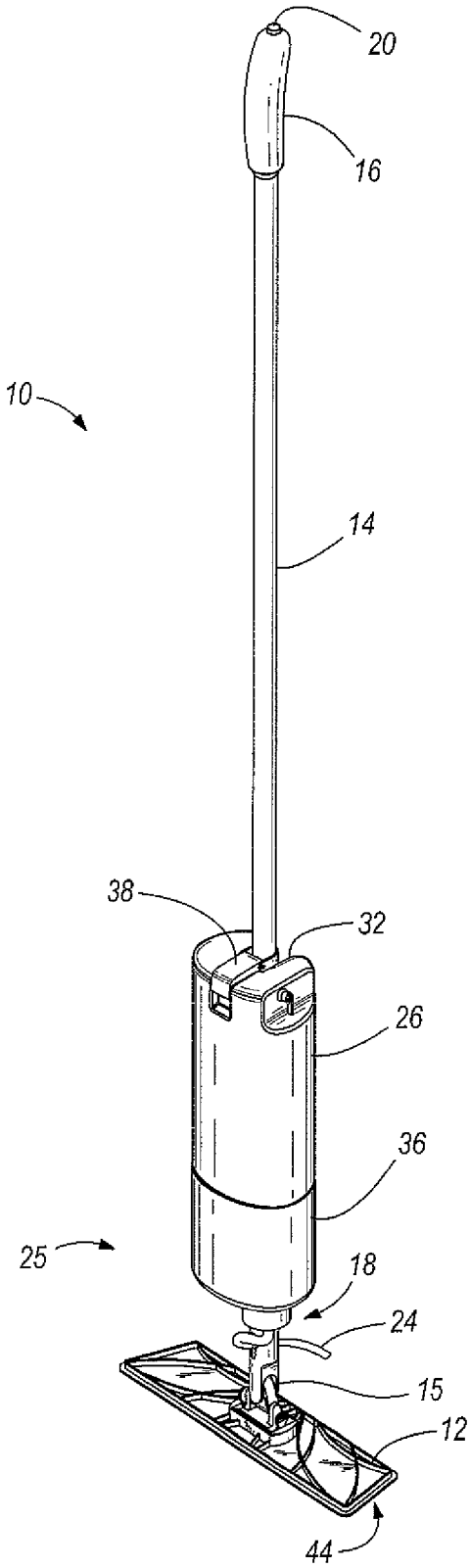
FIG. 1 is a perspective view of a floor finish application tool embodying aspects of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being called out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings arc intended to exemplify embodiments of the invention. Accordingly, other alternative mechanical configurations are possible, and fall within the spirit and scope of the present invention.

DETAILED DESCRIPTION

Referring now to FIG. 1 of the drawings there is illustrated a floor finish application tool 10 according to the present invention. Specifically, the illustrated tool is designed and configured to apply a floor finish (Le., a composition capable of providing a temporary or permanent protective coating, typically a clear coating, onto the surface of floor, such as a floor coating or sealer) to a floor without encountering the maintenance and clogging issues seen in the prior art. Further, the floor finish application tool is configured to apply a substantially consistent and uniform layer of floor finish to a floor regardless of force applied to the tool by an operator.

The floor finish application tool 10 comprises a floor finish application head 12, an elongate handle 14 having a first end 15 pivotally attached to the head 12, and a portion adjacent an opposite second end 16 that is adapted to be manually engaged to move the head 12 along the surface. In some embodiments, such as the illustrated embodiment, the floor finish application tool 10 includes a floor finish delivery system 25, which includes a floor finish reservoir 26 and a conduit 24 extending from the floor finish reservoir 26. In such embodiments, a valve assembly 18 is also provided to control the flow of floor finish from the reservoir 26 to the floor. Furthermore, an actuator 20 can be coupled to the handle 14 to actuate the valve assembly 18.

As illustrated in FIG. 1, the elongate handle 14 has a first end or distal end 15 and a second end or proximal end 16. The distal end is pivotally attached to the head 12. Further, a portion adjacent the proximal end 16 is adapted to he manually engaged to move the head 12 along the surface.

In some embodiments, such as the one illustrated in FIG. 1, an actuator 20 can be coupled to the handle 14. The actuator 20 allows an operator to control or selectively dispense floor finish from a reservoir 26. The actuator 20 can be coupled to the handle 14 in many locations and it can be configured many different ways. For example, as illustrated, the actuator 20 has a push button configuration and is located on the proximal end 16 of the handle 14. However, in other embodiments, the actuator 20 can be located in a variety of positions adjacent the proximal end 16 (or in many other positions on the handle). Further, the configuration of the actuator 20 can be modified as well. For example, the actuator 20 can have a trigger configuration or other configurations known in the art. The actuator 20 is also coupled to a valve assembly 18. The actuator 20 can be coupled to the valve assembly 18 via linkages, rods, cables, other transmission assemblies and the like. As discussed in greater detail below, in some embodiments, the actuator can be an electronic actuator or switch.

In some embodiments, the actuator can be configured as a multi-stage actuator. For example, if it were configured as a two stage actuator, the actuator could be depressed (or otherwise actuated) to a first defined position to provide a first flow rate or to a second defined position to provide a second flow rate. In a gravity fed dispensing assembly, the second flow rate position can be utilized to overcome the loss of head pressure as the floor finish is dispensed. However, in other embodiments, the actuator is a single stage actuator having one defined flow rate (and variable flow rate at non-defined positions of actuation). Alternatively, multiple flow rates could be achieved by configuring the valve assembly as a multi-stage valve assembly having multiple predefined positions corresponding to a desired flow rate.

The valve assembly 18 is positioned adjacent the first end 15 of the handle 14 and is operable to regulate the flow of floor finish from a reservoir 26 to the floor. The valve assembly 18 has an open position in which floor finish flows to the floor and a closed position in which floor finish does not flow through the valve to the floor (or more specifically through a conduit positioned in the valve). As discussed above, the valve assembly can have multiple predefined open positions corresponding to multiple flow rates.

Although the valve assembly 18 can be configured many different ways, in the illustrated embodiment, the valve assembly 18 has a pinch valve configuration, such as those shown in European Patent No. 0997099, PCT Publication No. 86/05376, or German Patent No. 2932110. In other words, the valve assembly includes a first member and a second member wherein these two members are movable with respect to each other to define the open and closed positions of the valve assembly 18. As described in greater detail below, a resilient conduit 24 extends between the first member and the second member. In the closed position of the valve assembly 18, the first and second members pinch the conduit 24 and press the walls of the conduit 24 together to block all flow through the conduit 24. In the open position of the valve assembly 18, the first and second members are separated, which allows the resilient conduit 24 to return to a less compressed state and allows floor finish to flow through the conduit 24.

In one particular configuration of the pinch valve, the first member defines an opening for the conduit to extend through and the second member is moveable relative to the first member to selectively pinch the conduit against a wall of the first member. The handle 14 of the floor finish application assembly 10 has a passageway through which the actuator 20 extends to actuate the valve assembly 18. The second member of the valve assembly is moveable longitudinally relative to a stationary first member upon actuation of the actuator 20. The valve assembly 18 can include a spring biasing the second member to the closed position, wherein the first and second members press or pinch together opposite sides of conduit 24 to stop the flow of liquid through the conduit 24. Actuation of the actuator then moves the second member relative to the first member to define an open position. In other embodiments, the valve can be configured with two moving members that move toward each other to pinch the conduit.

Although it is not illustrated, the valve assembly 18 can further include a projecting member adapted to be manually engaged to move the valve members to the open position which can be useful, for example, to change the conduit.

The valve and actuator described above are generally mechanical valves and actuators. In some embodiments, one or more of these components can be substituted by or integrated with electronic components. For example, the actuator and/or valve can be replaced with an electronic actuator and valve. Similarly, an electronic pump can also be incorporated onto the floor finish application tool to assist with dispensing floor finish.

As indicated above, some embodiments of the floor finish application tool 10 include a floor finish delivery system 25. The embodiment shown in FIG. 1 includes a floor finish delivery system 25 that includes a replaceable floor finish reservoir 26 having a conduit 24 extending from the reservoir 26 to direct floor finish toward a specific location on a floor, such as adjacent the head 12. In some embodiments, the floor finish delivery system 25 is intended for a single use only. As such, once the reservoir 26 is depleted, the floor finish delivery system 25 is replaced with a new floor finish delivery system 25. This configuration substantially eliminates the possibility of clogging and the time consuming maintenance related to such clogs.

The reservoir 26 can be configured many different ways. For example, the reservoir can comprise a bag, a substantially rigid vessel or container, and the like. The reservoir 26 can also have an opening 27 closed by a screw cap, plug, or other suitable closure mechanism 29 through which opening the container 26 can be dispensed, and in some embodiments refilled. However, in some preferred embodiments, the reservoir 26 can be provided with a non-removable closure mechanism 29 to prevent the floor finish delivery system from being reused, which may prevent related clogging issues of reuse.

As mentioned above, the conduit 24 extends from the opening 27 of the reservoir 26 toward a floor surface to deliver floor finish from the reservoir 26 to the floor. The conduit 24 can be configured many different ways. However, as illustrated, the conduit 24 can comprise a resilient, flexible tube. Generally, the conduit is coupled to a closure mechanism 29 that is coupled to the opening in the reservoir. The conduit 24 can be coupled to the closure mechanism 29 via barbs extending from an outlet on the closure 29 or the conduit 24 can be coupled to the closure several other ways. For example, the conduit 24 can be welded or bonded to the closure 29. Additionally, the conduit 24 can include a shoulder or flange that is trapped against the closure 29 adjacent an outlet in the reservoir 26.

In one particular embodiment of the floor finish delivery system 25, the reservoir 26 is shipped to an operator with a shipping closure attached to the opening 27 and a dispensing closure is provided within a kit to be applied prior to use. In other words, the shipping closure is removed by the end user and the dispensing closure is applied to the reservoir by the end use. The conduit 24 is coupled to the dispensing closure 29 prior to the end user receiving the kit. The dispensing closure 29 can be provided with a tamper-resistant locking system, such as a ratcheting locking member, that engages a complimentary locking system on the reservoir to prevent the dispensing closure from being removed once applied. This generally prevents the floor finish delivery system 25 from being reused, which could cause clogging. As shipped, the conduit 24 can have the distal end of the conduit 24 sealed to prevent undesirable dispensing of floor finish while the floor finish delivery system 25 is being installed on the floor finish application tool 10. The distal end of the conduit can be sealed many ways. For example, a plug can be inserted in the conduit, the end can be heat sealed, the end can be adhered closed, the end can be pinched by a mechanical device, an adhesive member can be place over the opening defined in the conduit, and the like. Once the floor finish delivery system 25 is coupled to the tool 10, the seal can be removed.

FIGS. 3-7 illustrate one particular configuration of a floor finish reservoir 26. As illustrated, this reservoir has a generally cylindrical oval configuration. The reservoir 26 is provided with an elongated groove or recess 32 extending in the longitudinal direction. This groove or recess 32 extends substantially the entire length or height of the reservoir 26. This groove or recess 32 is also dimensioned and configured to receive and substantially surround the handle 14. In one particular configuration, the center of gravity of the reservoir is coincident with the recess 32. In other words, the center of gravity of the reservoir is located within the recess when the recess in oriented in a substantially vertical orientation. Such a configuration has been found to provide a better balance to the floor finish application tool 10. Specifically, by allowing the weight of the floor finish contained within the reservoir to be distributed around substantially the entire circumference of the handle 14, the floor finish application tool 10 is better balanced, which helps to reduce fatigue of the operator.

Figure 2:
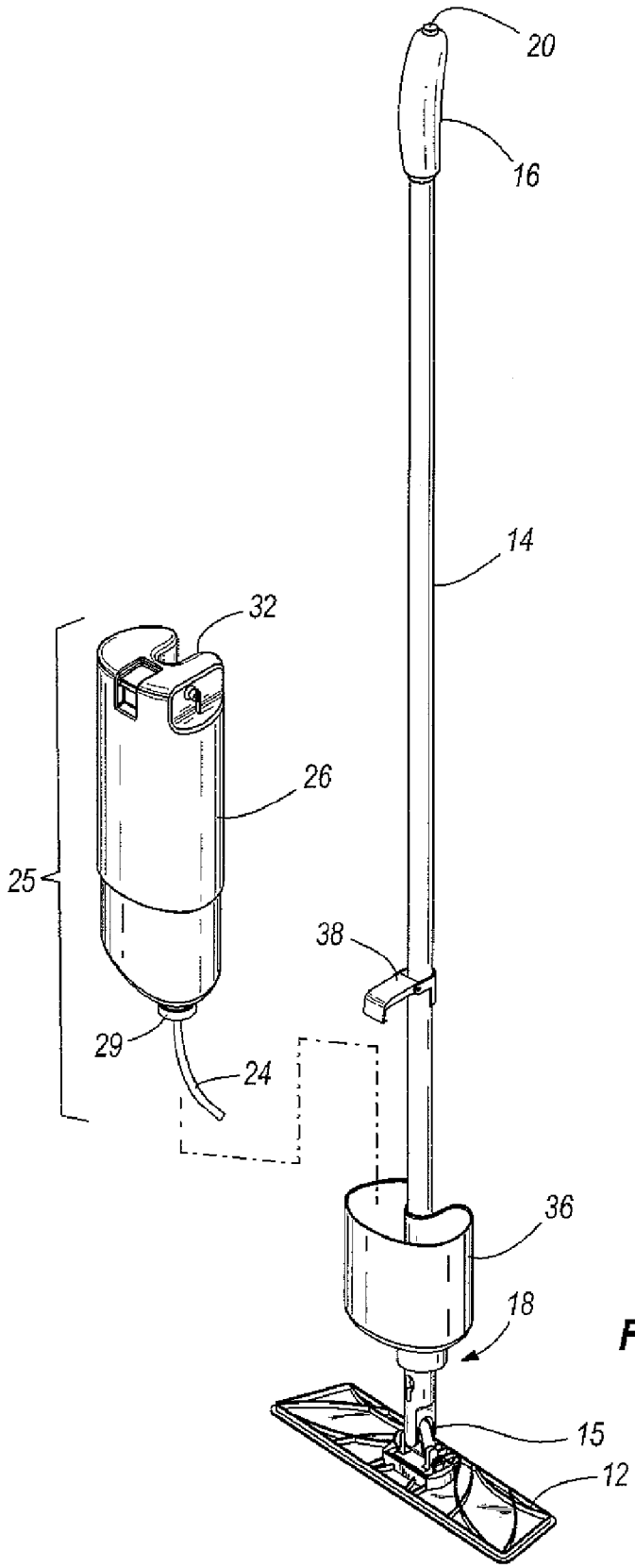
FIG. 2 is a partially exploded perspective view of the floor finish application tool shown in FIG. 1, with the floor finish delivery system shown exploded from the tool.
Figure 3:
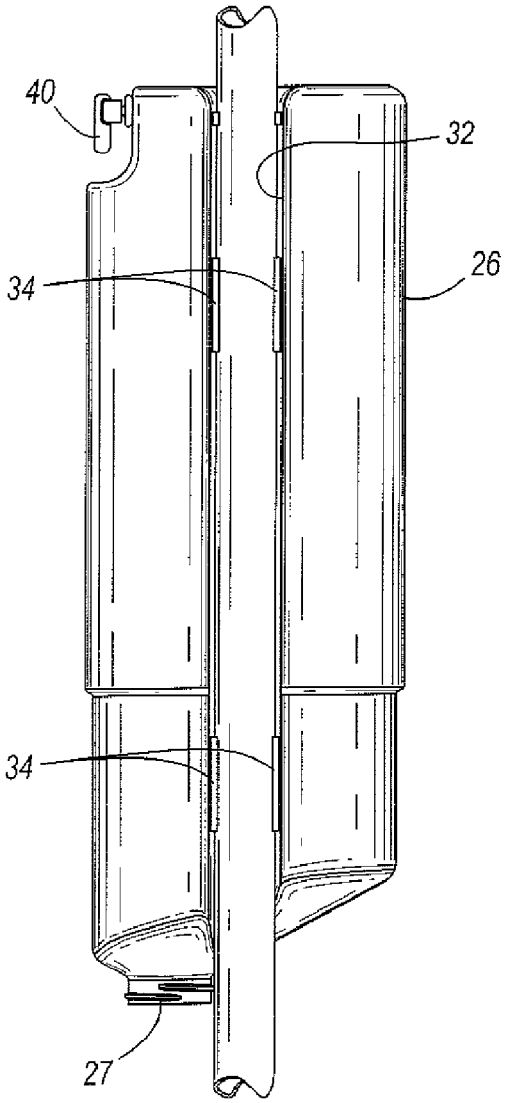
FIG. 3 is a front view of a floor finish reservoir embodying aspects of the invention.
Figure 4:
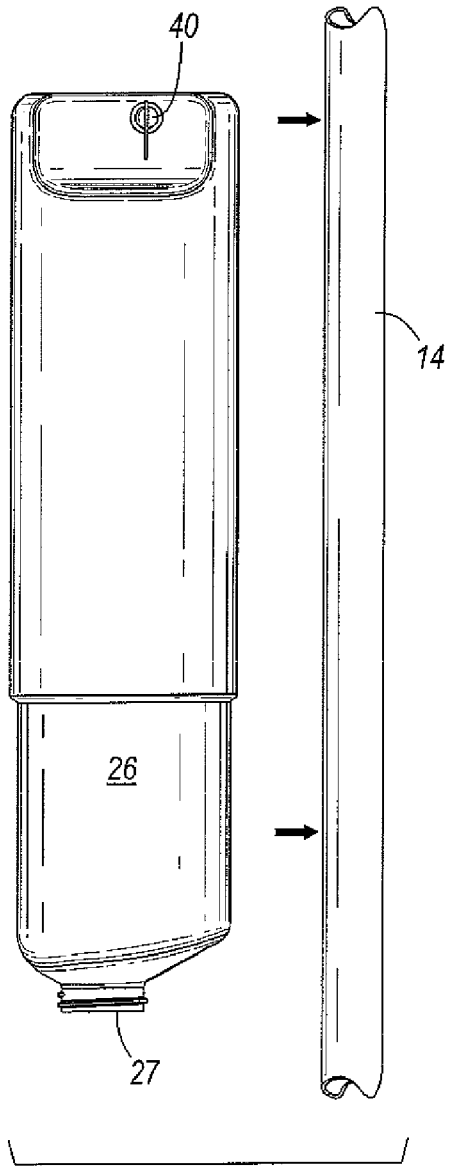
FIG. 4 is a side view of the floor finish reservoir shown in FIG. 3.
Figure 5:
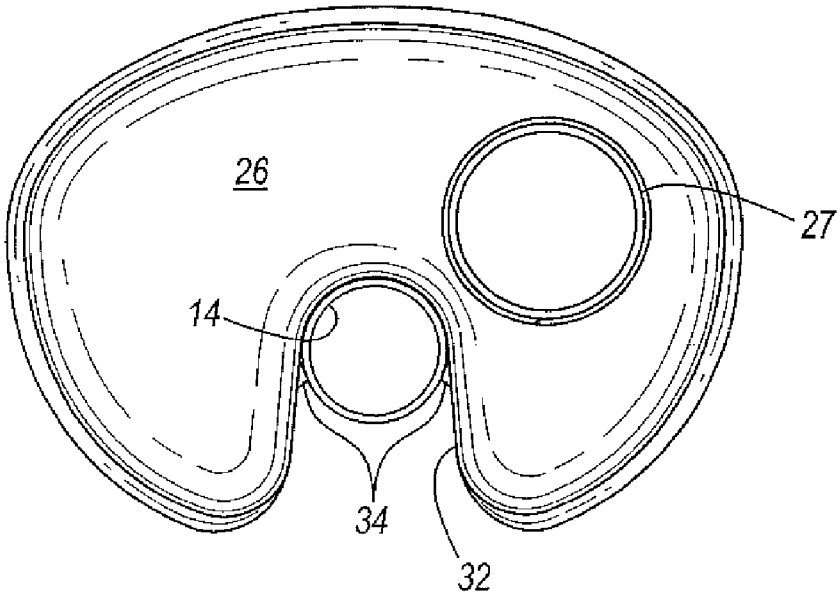
FIG. 5 is a bottom view of the floor finish reservoir shown in FIG. 3.
Figure 6:
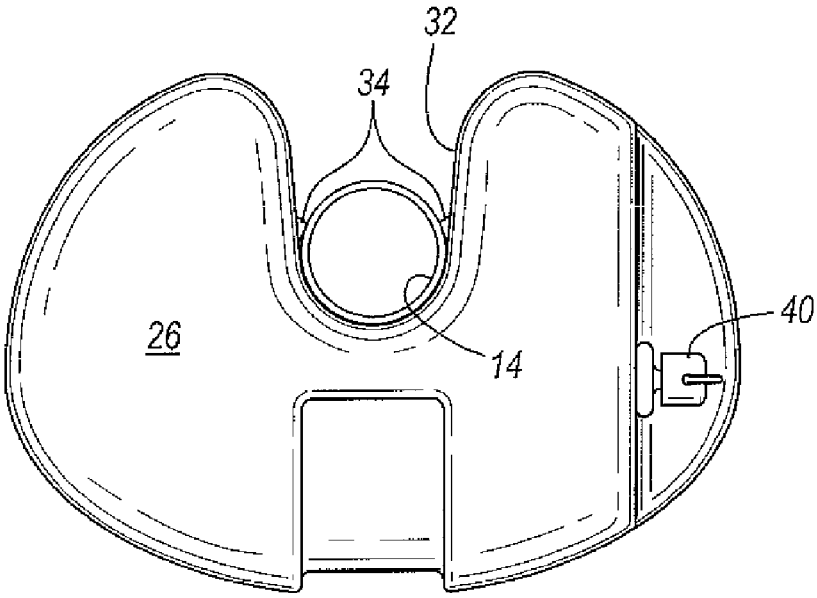
FIG. 6 is a top view of the floor finish reservoir shown in FIG. 3
Figure 7:
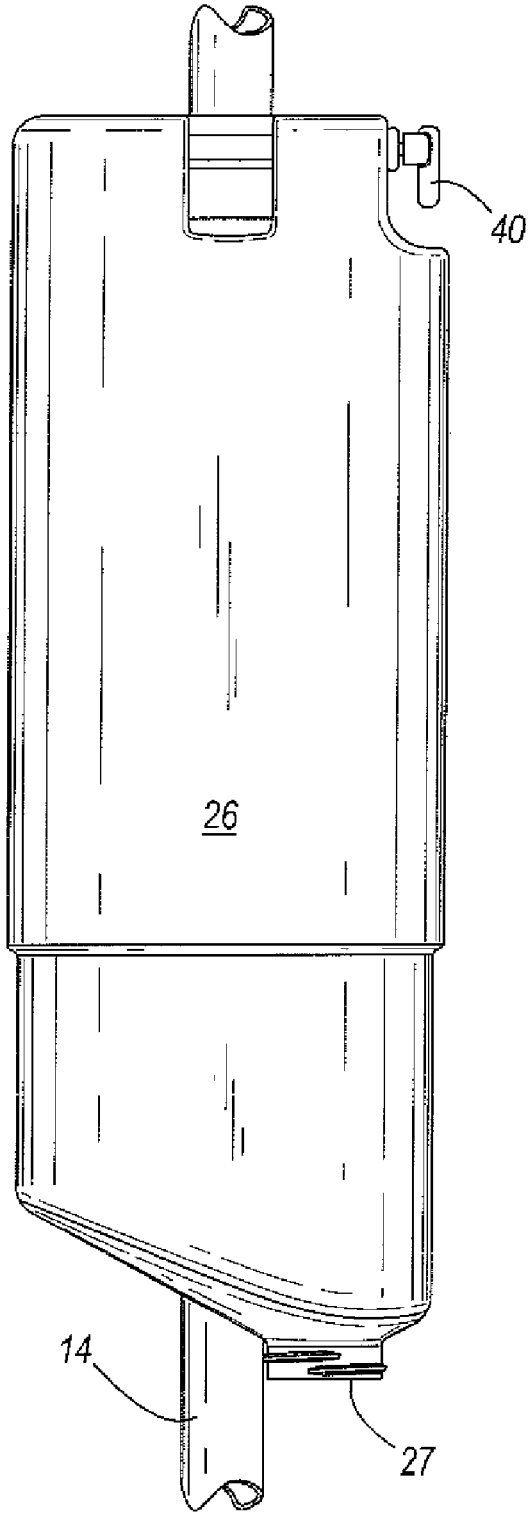
FIG. 7 is a rear view of the floor finish reservoir shown in FIG. 3.

In some embodiments, such as the one illustrated in FIGS. 3-7, one or more projections or tabs 34 can extend from the reservoir 26 into the recess 32. The projections 34 can engage the handle 14 to better secure the reservoir 26 to the handle 14. In some embodiments, the handle 14 can be provided with substantially complimentary recesses to receive the projections 34. Similarly, in some embodiments, the structure can be reversed, wherein the projections extend from the handle to be received on the reservoir. The use of these projections 34 can be sufficient in some embodiments to attach the reservoir 26 the floor finish application tool 10. However, in some embodiments, the floor finish application tool 10 may also be provided with a cradle, sleeve, or housing 36 coupled to the handle 14. The cradle 36 can be dimensioned and configured to receive a portion of the reservoir as shown in FIGS. 1 and 2.

Additionally, a latch mechanism 38 can be coupled to the handle 14 to retain the reservoir 26 against the handle 14. In one particular embodiment, the latch mechanism 38 includes a pivoting arm that engages and secures a portion of the reservoir. As illustrated in FIG. 1, the cradle 36 secures the bottom portion of the reservoir 26 and the latch mechanism 38 secures the top portion of the reservoir 26.

In some embodiments, the latch mechanism 38 can also include a member that punctures the reservoir 26 to provide a vent in the reservoir 26, which will help prevent a vacuum from forming within the reservoir while dispensing the floor finish. Specifically, the puncturing member can engage the reservoir 26 and puncture a portion of the reservoir while the latch mechanism 38 is being secured in place. However, in some embodiments, the puncturing member may require an additional movement to puncture the reservoir. Alternatively, the reservoir can be provided with a vent many other ways. For example, a vent can be incorporated in the closure. In some embodiments, such as the one shown in FIGS. 3-9, the reservoir 26 can include a break away member 40, such as a twist-off tab, that provides an opening or vent in the reservoir when broken away. As illustrated, the break-away member 40 preferably is placed within a recessed area on the reservoir 26 to prevent accidental breakage of this member. In yet other embodiments, other venting mechanisms can be utilized, such as conventional venting methods, assemblies, and devices.

Although it is not illustrated, in some embodiments of the reservoir, the reservoir is provided with a funnel adjacent the opening in the reservoir on the interior of the bottle. This configuration has been found to help evacuate all of the floor finish contained within the reservoir.

As discussed above, the distal end 15 of the handle 14 is coupled to the head 12. Specifically, the distal end 15 of the handle 14 is pivotally coupled to the head 12 via a joint, such as a ball joint, universal joint, hinge, or the like. The head 12 includes a fastening means for fastening a floor finish application pad 44 to the head 12. This fastening means can include substantially any fastening means known in the art, such as mechanical fasteners like hook and loop fasteners, elastic grabbing members, pinching members, pockets received by the head, and the like.

Figure 8:
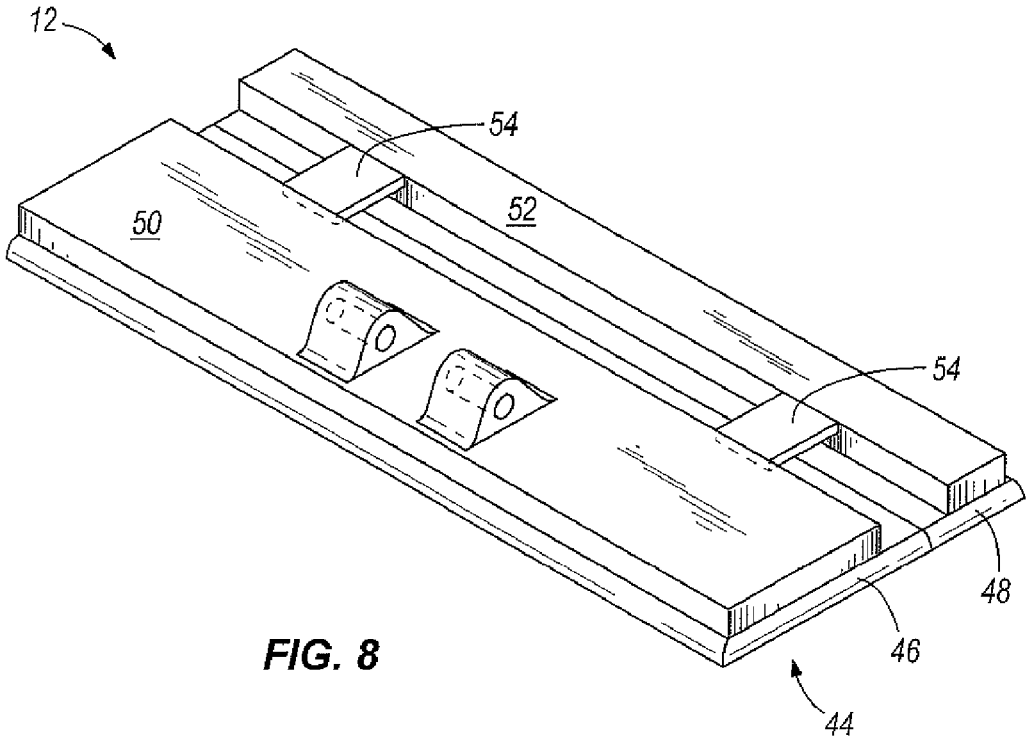
FIG. 8 is a perspective view of a two portion floor finish application head and floor finish application pad embodying aspects of the present invention.
Figure 9:
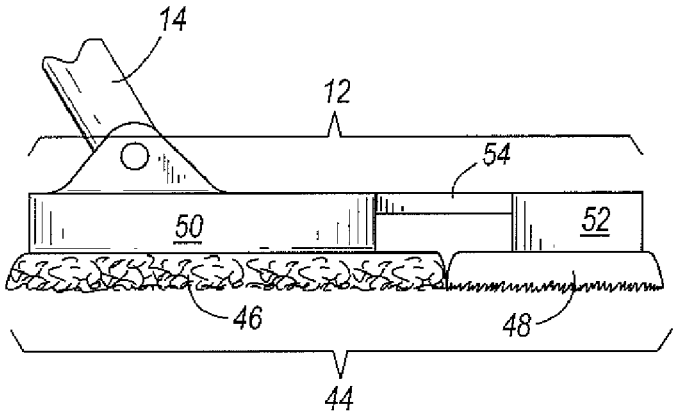
FIG. 9 is a side view of the floor finish application head and pad shown in FIG. 8.

Some embodiments incorporate an articulated floor finish applicator head 12, such as illustrated in FIG. 8. As shown in this figure, the head 12 includes a first portion or main body portion 50 that is directly coupled to the handle 14. The head 12 also includes a second portion or free floating portion 52 that is coupled to the main body portion 50 via a hinge 54. The second portion 52 is provided with a predefined weight to provide a constant force to the floor. This predefined weight can be manually adjusted in some embodiments by adding or removing weighted members to this second portion 52 or by switching the second portion currently in use for one having a different weight.

With this type of head 12, the first and second portion 50, 52 of the head 12 can serve different functions with respect to applying a floor finish to a floor. The first portion 50 generally is used to spread or distribute the floor finish across the floor, while the second portion 52 levels the floor finish previously spread by the first portion 50 and removes any streaks or brush marks left by the first portion 50. The second portion 52 is able to serve this function because it is free floating, which means that it applies a substantially constant force to a floor surface regardless of the force applied to the handle 14 by the operator. As such, the second portion 52 can help provide a constant floor finish appearance and floor finish thickness on a floor.

Figure 10:
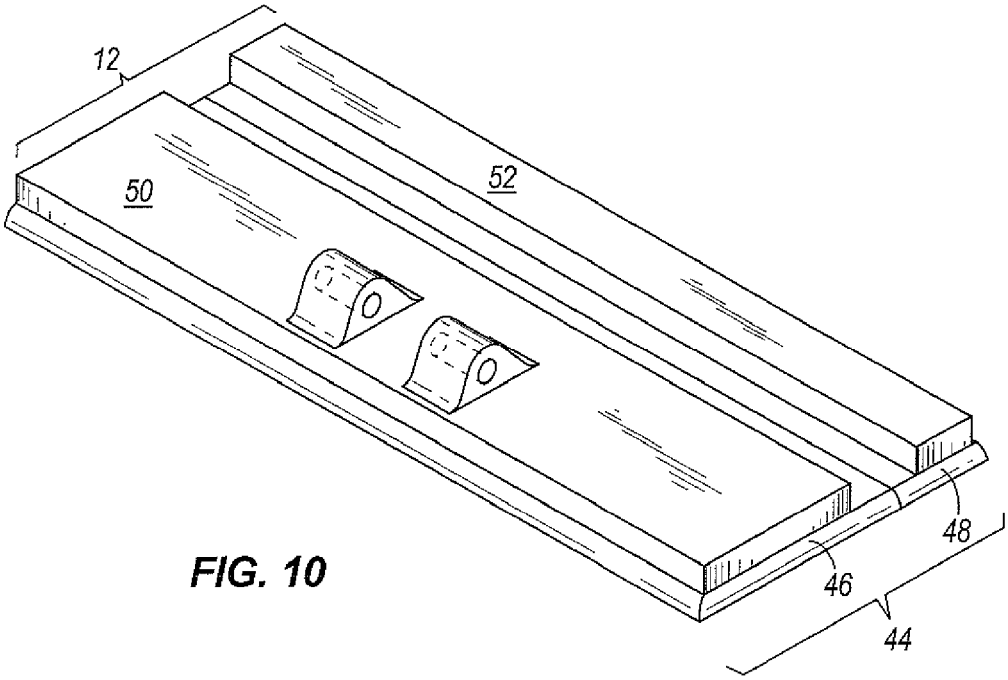
FIG. 10 is a perspective view of an alternative floor finish application head and pad embodying aspects of the present invention.
Figure 11:
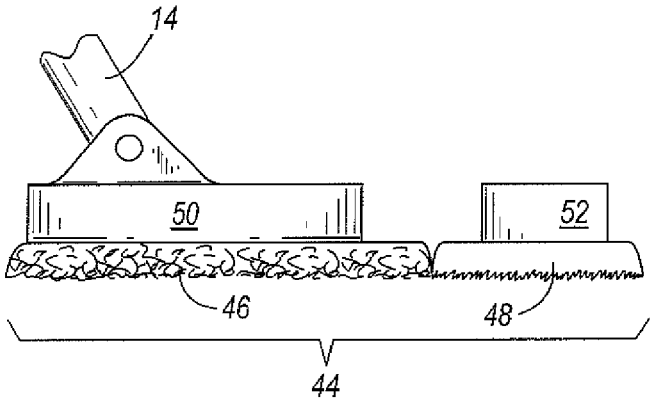
FIG. 11 is a side view of the floor finish application head and pad shown in FIG. 10.

The hinge 54 connecting the first portion 50 to the second portion 52 can be constructed and configured many different ways. For example, in some embodiments, such as shown in FIG. 8, the hinge 54 is a flexible elastic member, such as a strip of rubber. However, in other embodiments, the hinge 54 can be a rigid member having a pivot or other articulation point. In yet other embodiments, the second portion 52 is coupled to the first portion 50 via the applicator pad 44, such as shown in FIG. 10. In other words, the second portion 52 is fastened directly to the applicator pad 44 and the applicator pad 44 is the only member connecting the second portion 52 to the first portion 50. In yet other embodiments, the hinge is any other flexible member, such as a cable, rope, fabric, and the like.

As indicated above, an applicator pad 44 is coupled to the head 12. In some embodiments, the applicator pad 44 is a conventional floor finish application pad commercially available. However, in other embodiments, the applicator pad 44 has a unique construction comprising a first portion 46 and a second portion 48 having different material properties. For example, the first portion 46 comprises a continuous floor finish distribution material while the second portion 48 comprises a continuous floor finish smoothing or finishing material. This construction is able to uniformly spread floor finish on a floor and yet exhibit very low drag forces compared to conventional applicator pads. As discussed in greater detail below, the reduced drag characteristic of the applicator pad 44 of the invention results from the incorporation of a relatively stiff fibered floor finish distributing material into the applicator pad.

Referring now to FIGS. 8-11, one embodiment the applicator pad 44 is illustrated, which includes a working surface having at least two different materials: a floor finish distributing material 46, which can be made up of stiff or large denier fibers, such as tufted polypropylene and/or polyethylene fibers, and a floor finish finishing material 48, which can be made up of relatively soft, smooth, or small denier fibers, such as polyester microfibers. Generally, the floor finish distributing material is positioned adjacent to the floor finish finishing material, such that the floor finish would contact the floor finish distributing material first and the floor finish finishing material second. Furthermore, as arranged on the floor finish applicator head 12, the floor finish distributing material 46 is generally positioned adjacent or under the first portion 50 of the head 12 and the floor finish finishing material 48 is positioned adjacent or under the second portion 52 of the head 12.

The applicator pad 44 generally contains a sufficient amount of floor finish distributing material 46 to reduce the drag as compared to a pad lacking floor finish distributing material, but does not contain so much floor finish distributing material that the quality of the coating is significantly reduced. In one embodiment, the working surface of the pad contains about 55% of the floor finish distributing material, e.g. stiff fibers, and about 45% of the floor finish finishing material, e.g., softer or absorbent fibers. However, in other embodiments, these relative proportions can be modified. For example, in some embodiments, the pad comprises at least a continuous 50% floor finish distributing material. In other embodiments, the pad comprises at least a continuous 60% floor finish distributing material. In yet other embodiments, the pad comprises at least a continuous 70% floor finish distributing material. In yet other embodiments, the pad comprises at least a continuous 75% floor finish distributing material. As used in this paragraph, the term continuous means that the material is not interrupted by another material within a defined direction, such as in the direction of pad movement across the floor. Similarly, the measure of percent can be measured several ways, such as total surface area covered or length occupied in a single direction, such as the direction of pad movement across a floor.

The height of the floor finish distributing material 46 may be greater than that of the floor finish finishing material 48. Alternatively the height of the floor finish distributing material may be substantially equal to that of the floor finish finishing material, or the floor finish finishing material may even have a greater height. Generally, regardless of relative height or thickness of materials, the interface between the materials should be generally level or smooth between the materials where they contact the floor.

A variety of different materials may be used as the floor finish distributing material 46. Stiff or large denier fibers can be as the distributing element in the floor finish applicator tool 10. The stiff or large denier fibers can be monofilaments, yarns, tows, or bound filamentous materials. The bound materials may be bonded together by adhesive, welding, wrapping, or other methods known in the art. Stiff fibers (i.e., fibers that resist compression under load) or large denier fibers (i.e., a relatively thick, heavy, or stiff fiber, bundle of fibers, tow, or yarn having a denier of at least about 10 more typically at least about 15 denier) having a high bending stiffness and high elasticity axe particularly well suited as a floor finish distributing material. Typically, the stiff or large denier fibers have low water absorbance, low compressibility, and low flexibility. However, the materials that may be used as a floor finish distributing material arc not limited to filament fibers, and could also includes webs, such as three dimensional fiberous webs, foams, flocked foam, and other sponge-like materials, needle punched material, open celled material, and the like. In one particular embodiment, the floor finish distributing material is an open non-woven three-dimensional web formed of interlaced randomly extending flexible fibers, wherein the interstices between adjacent fibers are open thereby creating a tri-dimensionally extending network of intercommunicated voids. Generally, with such a structure the voids form at least 50% of the volume of the material. More preferably, the voids faun at least 75% of the volume of the material. Furthermore, this material is preferably flexible, compressible, and capable of resiliently returning to a substantially uncompressed form.

Examples of floor finish distributing materials for the applicator pad 44 include, but are not limited to, polypropylene and/or polyethylene fibers. Additional floor finish distributing materials include nonwoven materials such as, for example, the low density open non-woven fiberous material described in U.S. Pat. Nos. 2,958,593 and 4,893,439, and woven materials such as scrims and screens. Furthermore, other open structured materials included well spaced brushes can be used. Substances suitable as floor finish distributing materials include, but are not limited to, polypropylene, polyethylene, polyesters, polyurethanes including modified polyurethanes, polyamides such as nylons, and mixtures and combinations thereof.

The most preferred materials have a Compression Resistance of about 84 or greater. However, some materials having a Compression Resistance of about 81 or greater may provide at least some of the benefits disclosed herein. One possible test to determine the Compression Resistance of a material is the ASTM D6571 test. This test includes multiple stages of adding and removing a mass from the pad to determine the compression with a mass and the relaxation after the mass is removed. The following Table I shows a summary of pad sizes and mass values that were used during the test:

TABLE I

| | Top/base plate | | Top plate | | Sample | | Mass | Mass per sample |
|---|---|---|---|---|---|---|---|---|
| | Cm * cm | $cm^2$ | Gram | per sample · g/cm2 | Cm * cm | $cm^2$ | Gram area $cm^2$ | $g/cm^2$ |
| ASTM D6571 | 23 × 23 | 529.0 | 187.0 | 0.47 | 20 × 20 | 400.0 | 7260 | 18.150 |
| Set-up #1 | 18 × 18 | 324.0 | 88.16 | 0.39 | 15 × 15 | 225.0 | 4073 | 18.102 |
| Set-up #2 | 18 × 18 | 324.0 | 89.11 | 0.40 | 15 × 15 | 225.0 | 4073 | 18.102 |

During the ASTM test, the initial pad height is measured and then the height is measured immediately after a mass is positioned on the pad and then again after ten minutes have elapsed with the mass on the pad. The mass is then removed and the height is immediately measured and then again after ten minutes without the mass on the pad. These steps are repeated for different time periods, which are modified from a true ASTM D6571 test. The mass is replaced for two hours, instead of twenty-four hours as specified in the test. The height is measured immediately as the weight is supported on the pad and after two hours of supporting the weight. The weight is removed and the height is measured immediately and again after thirty minutes have elapsed. The data collected from the test are included below in Table II:

TABLE II

| Summary of Data Height, inch | Initial No mass A | 0 min Mass B | 10 min Mass C | 0 min No mass D | 10 min No mass E | 0 min Mass F | 2 hr Mass G' | 0 min No mass H' | 30 min No mass J' |
|---|---|---|---|---|---|---|---|---|---|
| Tuway ® green pad | 5.0313 | 4.1094 | 3.8906 | 4.7188 | 4.8750 | 3.8750 | 3.7656 | 4.5625 | 4.6875 |
| Glit ® white pad | 4.8594 | 4.1250 | 4.1094 | 4.5938 | 4.6719 | 4.0625 | 3.9375 | 4.3125 | 4.5469 |
| Rubbermaid ® Q800 | 5.4375 | 4.6563 | 4.3906 | 5.1719 | 5.2344 | 4.5000 | 4.1719 | 4.8281 | 5.0938 |
| 3M ® 90 | 5.2031 | 4.5156 | 4.4531 | 5.1250 | 5.1719 | 4.5000 | 4.5000 | 4.9375 | 5.0625 |
| Ahistrom HF 32D | 5.7656 | 4.0000 | 3.9063 | 4.6094 | 5.5000 | 3.9375 | 3.7656 | 4.9688 | 5.2188 |
| Glit ® yellow pad | 4.9688 | 4.2969 | 4.1719 | 4.5938 | 4.6875 | 4.2344 | 4.0469 | 4.3906 | 4.5781 |

Three variables were calculated from these results, L, M and L-2 hr. L is the compression resistance and is equal to one-hundred multiplied by the height after the mass has been positioned on the pad for ten minutes, divided by the initial no-mass height. M is the elastic loss and is equal to one hundred multiplied by the difference between the initial no-mass height and the relaxed height after ten minutes, all divided by the initial no-mass height. L-2 hr is the compression resistance of the pad for the second time the mass is applied and after two hours have elapsed. Specifically, L-2 hr is equal to one hundred multiplied by the height after the mass has been applied for two hours divided by the recovered height after the mass has been removed for ten minutes. To summarize, the formulae are L=100*C/A, M=100*(A-E)/A, and L-2 hr-100*G'/E, as taken from Table II. A summary of the data, including calculated values L, M and L-2 hr, is included in Table III below:

TABLE III

| Summary of Data Height, inch | 10 min L | M | 2 hr L-2 hr |
|---|---|---|---|
| Tuway ® green pad | 77.3 | 3.11 | 77.2 |
| Glit ® white pad | 84.6 | 3.86 | 84.3 |
| Rubbermaid ® Q800 | 80.7 | 3.74 | 79.7 |
| 3M ® 90 | 85.6 | 0.60 | 87.0 |
| Ahlstrom HF 32D | 67.8 | 4.61 | 68.5 |
| Glit ® yellow pad | 84.0 | 5.66 | 86.3 |

The data in Table III indicate that the Gilt® white pad, the 3M® 90 pad and the Gilt® yellow pad all have a Compression Resistance of at least about 84 and therefore are some of the most preferred materials as defined above.

Suitable floor finish finishing materials include those that are able to provide a smooth coating without leaving undesired streaks or brush marks. Highly absorbent or adsorbent fibers or microfibers are particularly well suited as a floor finish finishing material. Also, small denier fibers (i.e., a fine fiber, bundle of fibers, tow, or yarn having a denier of no more than about 1 denier) have also shown to be a well suited material.

However, as with the floor finish distributing material 46, the floor finish finishing material 48 may be constructed of materials other than filament fibers, such as, for example, webs, foams, and other sponge-like materials, plastic elements, and the like. Exemplary floor finish finishing materials include, but are not limited to, polyester fibers, rayon, cotton, wool, polyolefins, polyamides such as nylons, and combinations thereof.

In one particular embodiment illustrated in FIGS. 8-11, a first continuous portion of the working surface is floor finish distributing material 46, while the trailing continuous portion of the working surface is floor finish finishing material 48. In another embodiment illustrated in FIG. 12, a first continuous portion of the working surface is a floor finish finishing material, a second continuous portion (adjacent the first portion) of the working surface is floor finish distributing material, while the trailing continuous portion (adjacent the second portion) of the working surface is floor finish finishing material. With this particular configuration, it has been found that the first portion of floor finish finishing material helps to distribute bulk floor finish from a single location to the outer extents of the head. Generally, this first portion is relatively small (i.e. strip) to prevent additional drag and unnecessary absorption of floor finish. The remaining two portions work as described in the previous example. In the three material embodiment, the relative proportions of each material can he as discussed below. The first portion can be less than about a continuous 10% of the pad and more specifically, less than about a continuous 5% of the pad in some preferred embodiments. The second portion can comprise at least a continuous 50% of the pad. In other embodiments, the pad comprises at least a continuous 60% floor finish distributing material. In yet other embodiments, the pad comprises at least a continuous 70% floor finish distributing material. In yet other embodiments, the pad comprises at least a continuous 75% floor finish distributing material. As used in this paragraph, the term continuous means that the material is generally not interrupted by another material with substantially different finishing characteristics within a defined direction, such as in the direction of pad movement across the floor. Similarly, the measure of percent can be measured several ways, such as total surface area covered or length occupied in a single direction, such as the direction of pad movement across a floor.

In certain embodiments, the floor finish distributing material 46 may be the same type of fiber/material as the floor finish finishing material 48, for example, by providing regions on the working surface in which the floor finish finishing material 48 is packed tightly enough that it is able to provide the support function. In other embodiments, the floor finish distributing material 46 and the floor finish finishing material 48 may comprise the same type of fiber or chemical compound that has been configured to provide different mechanical/physical properties. For example, the floor finish distributing material 46 and the floor finish finishing material 48 may be the same type of material that has been woven differently, or has a different denier or density, or has been treated with a resin coating, or similar treatment that imparts the floor finish distributing material 46 with different properties from the floor finish finishing material 48.

The applicator pads 44 of the invention may be fabricated using any well-known technique for fabric construction, depending on the materials to be used. They may be manufactured using methods such as circular knitting, weaving, needle punching, tufting, and the like.

The fabric used in the applicator pad 44 can be sewed after being covered with a cloth. Finishing the edges in this manner helps to prevent fraying of the fabric and keeps the shape of the applicator pad 44. The edges may be finished, for example, by adding a sheet with an adhesive to the non-working side of the fabric. The edges of the sheet and the fabric are then overlooked or covered by a cloth and sewed to make the finished edges.

Previously, the use of stiff or large denier fibers in applicator systems for applying coatings onto substrates was often associated with undesired streaks or brush marks in the coating. One of the advantages of the present invention is that the applicator pad 44 contains stiff fibers in combination with soft, smooth, or absorbent fibers reduces drag of the applicator pad 44 while still providing a smooth coating, substantially free of streaks or marks. As discussed below, the use of floor finish distributing material 46 in combination with a floor finish finishing material 48 has a surprisingly dramatic reduction in drag without compromising the quality of the coating that is achieved. Furthermore, the use of a continuous section of floor finish distributing material 46 in series with a continuous section of floor finish finishing material 48 has been found to provide substantially uniform coating on a floor, regardless of pressure applied the floor finish application tool by the user.

The operation of a floor finish applicator tool 10 utilizing a floor finish delivery system 25 will now be described. In operation, a floor finish applicator tool 10 is provided having a head 12 with applicator pad 44, a handle 14 coupled to the head 12, and a valve 18 and actuator 20 coupled to the handle 14. A floor finish reservoir 26 is be coupled to a floor finish delivery conduit 24 and then coupled to the applicator tool 10. As the floor finish reservoir 26 and conduit 24 are coupled to the tool 10, the conduit 24 is extended through the valve 18. Once the conduit 24 is extended through the valve 18, the seal on the conduit 24 can be removed and floor finish application can begin.

In operation, the actuator 20 is actuated when the delivery of floor finish to the floor is desired. Actuation of the actuator 20 causes actuation of the valve 18, which when actuated releases the compressive force on the walls of the floor finish delivery conduit 24. When the compressive force is removed, floor finish can flow from the reservoir 26, through the conduit 24, and to the floor. Once the floor finish is on the floor, the floor finish is distributed via the head 12 and applicator pad 44.

Once the floor finish reservoir 26 is empty, the reservoir 26 and conduit 24 is removed from the floor finish applicator 10 as a single assembly. Generally, the reservoir 26 and conduit 24 arc discarded (i.e., not refilled and reused). However, in some embodiments, the reservoir 26 and/or conduit 24 may be able to be reused. In the present invention, it is generally envisioned that a new reservoir 26 is provided along with a new conduit 24. The conduit 24 is coupled to the reservoir 26 as discussed above and the reservoir 26 and conduit 24 are coupled to the floor finish applicator tool 10 as discussed above. By providing a new reservoir 26 and conduit 24 each time, the chance of clogging is substantially diminished and so is the need for time consuming maintenance related to a clog. Furthermore, assuming a clog forms, the floor finish delivery system 25 can be discarded and replaced with a new floor finish delivery system 25 instead of performing costly, time consuming maintenance.

The operation discussed above related primarily to the floor finish delivery system 25 independent of the type of head 12 and floor finish applicator pad 44 utilized. The operation of a floor finish applicator tool 10 having a hinged head 12 and two material applicator pad 44 will now be described. For the purpose of this description, it will be assumed that the floor finish delivery system 25 described above is utilized. However, such a floor finish delivery system is not necessary. Rather, other conventional methods of delivering floor finish can be utilized. In operation, a floor finish applicator tool 10 is provided having a handle 14 and a head 12 with an applicator pad 44 coupled to the head 12. As mentioned above, the head 12 has a hinged two part construction as described above and the applicator pad 44 comprises two continuous materials having different properties, as described above. The pad 44 is generally attached to the head 12 with one of the materials positioned substantially adjacent the first portion of the head 12 and the other material positioned substantially adjacent with the second portion of the head 12.

To spread floor finish on the floor, the first material 46 contacts the bulk floor finish deposited on the floor and spreads the bulk floor finish substantially evenly over the floor regardless of the pressure applied to the floor via the applicator pad 44 (from the operator). The substantially even spreading is accomplished by the continuous floor finish distributing material 46, which resists compression from the force applied by the operator. Specifically, due to the open celled nature of this material, regardless of force applied to the applicator pad, substantial interstitial spaces within this material remain in contact with the floor. As such, floor finish is not removed from the floor in these interstitial areas. If a conventional application pad were used, greater pressure would generally result in less floor finish being applied because substantially the entire pad would compress and a significant number of fibers would contact the floor surface (with very few voids remaining) and act like a squeegee to remove already applied floor finish. In other words, in the present embodiment, the open cell structure resists compression and generally provides a consistent amount of contact with floor regardless of force applied. Due to this property, a consistent layer of floor finish is always spread over the surface of the floor regardless of pressure applied by the operator. Unfortunately, due to the coarse, open cell nature or this material, although the floor finish is distributed substantially evenly over the floor, the floor finish is generally not smooth. Specifically, the floor finish is left with fine lines, streaks, or brush marks. However, the open cell structure of this material allows the floor finish to be evenly spread without much floor finish being trapped (and wasted) in this portion of the applicator pad 44. Further, the open cell structure of this material allows the floor finish to flow between the voids, opposed to being scraped off by conventional applicators lacking voids.

The second material 48 positioned adjacent the second portion of the head 12 is specifically selected to smooth the finish and substantially eliminate the fine lines or brush marks. Further, since this material is positioned adjacent the second portion of the head 12, which is substantially free floating (i.e., provides a constant pressure against the floor surface regardless of the force applied by the operator to the handle due to the hinged construction), the distribution of the floor finish over the floor is not effected. Rather, this second material 48 generally only smoothes the already distributed floor finish by eliminating peaks of floor finish left by the open cell, coarse material. Specifically, the relatively soft, fine denier material reduces or substantially eliminates the peaks defining each brush mark or fine line, which makes the floor finish much smoother. The peaks are sheared off, deformed, or otherwise reduced or eliminated by the second material.

An example of the above operation is provided below in Table IV. In this example, three different operators applied floor finish to a floor using the same tool and the same technique. The tool was weighed before use and after use to determine the amount of floor finished used. The results of this test is as follows:

TABLE IV

| | Area Covered (sq. m) | Amount of Finish Applied (g) | Grams used per sq. meter |
|---|---|---|---|
| Operator 1 | 18.8094 | 390.5 | 20.7 |
| Operator 2 | 19.2096 | 402.4 | 20.9 |
| Operator 3 | 9.492 | 180.9 | 19.1 |

As this chart illustrates, the configuration of the head and the application pad of this invention generally eliminate the effects of the operator on the floor finish coat. As shown above, the coat applied by each operator is about 20 grams per square meter. Note that although this test shows that this applicator pad helps eliminate the effects of individual application pressure, it does not eliminate the effect of the floor finish application method. Specifically, if one use dumps floor finish onto a floor while another meters the floor finish from a tank, the coat thickness will like be different for the two application methods. However, if the same application method is used, this tool eliminates the effects the application pressure variable has on coat weigh.

A test procedure was used in order to compare the average coat weight produced by various pads and pads that include combinations of first material 46 and second material 48. The pad combinations are labeled as Prototype A, Prototype B, etc. and are included below in Table V:

TABLE V

| | Part A | | Part B | |
|---|---|---|---|---|
| Prototype | Front warp | pad | Cloth | PVC pipe |
| A | 0.5-0.75: | 3M ®-90, 4": | 1-1.5" | X |
| B | 0.5-0.75: | HF-32D (Ahlstrom) | | X |
| C | 0.5-0.75" | Glit ® white light duty hand pad, 4" | 1-1.5": | X |
| D | 0-5-0.75" | 3M ®-90, 4" | 0.5-0.75" | no pipe |

In Table V, Part A is first material 46 and part B is second material 48 and the PVC pipe is used to consistently weigh down the second material 48, since second material 48 is hinged off of the first material 46. In the present test, part A is an incompressible piece that spreads out the floor finish and Part B smoothes out the finish to level the uneven portions of coating. Prototypes A-D that include first and second materials 46 and 48, respectively were tested against a Tuway® green pad and a Rubbermaid® Q800 pad that include only first material 46. The pads were used with various weights attached to the mop, for example, without a bottle, with a partially filled bottle and with a full bottle. In the present test, a 2.5 L capacity bottle was used. The various weights are used to indicate the consistency of coat weight over multiple runs and while supporting various weights. The pads were pre-wet and then run a first time prior to the following results being recorded to more accurately record the average coat weight. The results are listed below in Table VI:

TABLE VI

| Coat weight, average, g/ft$^2$ 4 runs, #2-5 (exclude the pre-wet & 1st run) | | | | |
|---|---|---|---|---|
| Applicator set-up In Pounds | w/o bottle 1.98 | ¼ filled bottle 4.08 | ½ filled bottle 5.74 | full filled bottle 7.92 |
| Tuway ® green pad | 2.24 | 1.95 | 1.64 | 1.56 |
| Prototype A | 2.60 | 2.50 | 2.22 | 2.14 |
| Rubbermaid ® Q800 | 2.42 | 2.00 | 1.70 | 1.63 |
| Prototype B | 3.05 | 2.68 | 2.41 | 2.03 |
| Prototype C | 2.85 | 2.67 | 2.4 | 2.17 |
| Prototype D | 2.69 | 2.58 | 2.35 | 2.04 |

These data illustrate and indicate that inventive configuration of the applicator pad discussed herein helps control coat weight. Further, the percent of compression from weight was calculated from the collected data. Specifically, Table VII (included below) illustrates the % change versus head pressure, and clearly shows that this configuration does substantially reduce the effects of increased head pressure. More specifically, prototype A and C had superior results versus control data from conventional pads (the Tuway® green pad and the Rubbermaid® Q800) and a negative control pad (Prototype B). In other words, these configurations substantially reduced the effects of increasing head pressure on the coat weight.

TABLE VII

| Percentage of compression from weight 4 runs, #2-5 (exclude the prewet & 1st run) | | | | |
|---|---|---|---|---|
| | w/o bottle 1.98 | ¼ filled bottle 4.08 | ½ filled bottle 5.74 | full filled bottle 7.92 |
| Tuway ® green pad | 100 | 87 | 73 | 70 |
| Prototype A | 100 | 96 | 85 | 82 |
| Rubbermaid ® Q800 | 100 | 83 | 70 | 67 |
| Prototype B | 100 | 88 | 79 | 67 |
| Prototype C | 100 | 94 | 84 | 76 |
| Prototype D | 100 | 96 | 87 | 76 |

As indicated above, some embodiments do not utilize a two portion head 12, but rather utilize a head 12 having a substantial portion of the applicator pad 44 extending beyond the periphery of the head 12 (i.e., about 10% or more of a single dimension of the pad extends out form under the head in a single direction). In such an embodiment, the applicator pad 44 portion positioned beneath the head 12 acts similar to the first material previously discussed to distribute the floor finish evenly and the applicator pad 44 portion extending beyond the periphery of the head 12 acts similar to the second material discussed above to smooth the distributed finish. The portion of the applicator pad 44 extending beyond the periphery of the head 12 can be provided with a weight to provide a greater, constant force on the pad 44 against the floor.

Figure 12:
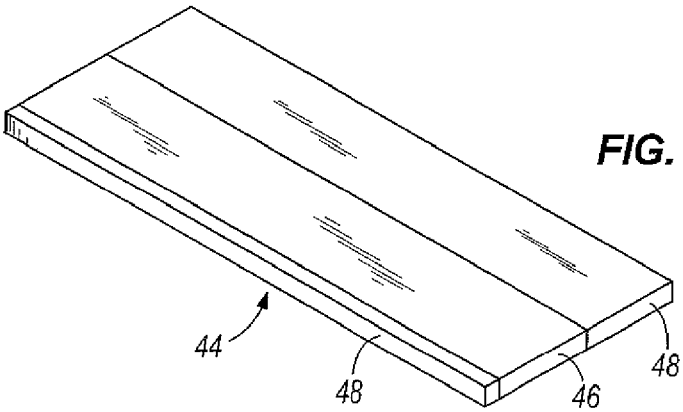
FIG. 12 is a perspective view of another floor finish application pad embodying aspects of the present invention.

Embodiments utilizing a three material applicator pad similar to the pad shown in FIG. 12 operate in substantially the same manner as described above. The greatest distinction is that the initial strip of applicator material helps to quickly distribute bulk floor finish to the outer extents of the pad. Due to the lack of voids in this part of the material, the bulk floor finish is more easily pushed around on the floor compared to the floor finish distribution material, which due to the substantial number of interconnected voids cannot distribute the floor finish to the outer extents of the pad as efficiently. Additionally, although this first strip of material tends to be more absorbent, due to the relatively small proportion of this material, friction is not that great.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, many inventive features were presented above and in many situations they were described in combination with other inventive features. However, there is generally no need to combine more than one inventive feature into a device. For example, the floor finish delivery system presented above does not need to be utilized in all embodiments. Specifically, this system does not have to be used with a multi-material pad described herein. Similarly, not all embodiments of the invention need to incorporate the two portion articulated head described above. Additionally not all embodiments of the invention need to incorporate the multi-material pad described above.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

The invention claimed is:

1. A floor finish application tool for applying a floor finish to a floor, the floor finish application tool comprising:

a floor finish application head;

an elongate handle having a first end pivotally attached to the head and a second end opposite the first end, the second end manually engageable to move the head along the floor;

a reservoir containing floor finish supported on the handle;

a pad coupled to the head and positioned between the head and the floor to receive floor finish from the reservoir, the pad having a first pad portion composed of a first material and a second pad portion composed of a second material, the first material being more coarse than the second material, each of the first and second pad portions having an elongate side, wherein the elongated sides of the first and second pad portions extend substantially parallel to one another, wherein the pad is movable in a direction along the floor using the handle to substantially evenly distribute floor finish on the floor with the first pad portion, and wherein the second pad portion, wherein the head has a first head portion supporting the first pad portion and a second head portion supporting the second pad portion, and wherein the first head portion and the second head portion are interconnected by a flexible member.

2. The floor finish application tool of claim 1, wherein the reservoir is removable from the floor finish application tool and replaceable when the floor finish within the reservoir is depleted.

3. The floor finish application tool of claim 2, further comprising a sleeve coupled to the handle, the sleeve shaped and configured to receive at least a portion of the reservoir and selectively couple the reservoir to the handle.

4. The floor finish application tool of claim 1, wherein the reservoir includes an elongated recess dimensioned to receive the handle substantially within the recess such that the weight of the floor finish within the container is distributed around substantially an entire circumference of the handle.

5. The floor finish application tool of claim 1, wherein the first and second pad portions comprise different materials.

6. The floor finish application tool of claim 5, wherein the elongated side of the second pad portion abuts the elongated side of the first pad portion.

7. The floor finish application tool of claim 1, wherein the first material is an open cell material.

8. The floor finish application tool of claim 1, further comprising a length of tubing coupled to the reservoir and extending toward the head for conveying floor finish from the reservoir to the floor, the reservoir and the tubing removable from the floor finish application tool and replaceable when the floor finish within the reservoir is depleted.

9. The floor finish application tool of claim 8, wherein the reservoir and the tubing are removed as a single assembly.

10. A floor finish application tool for applying a floor finish to a floor, the floor finish application tool comprising:

a floor finish application head having a first head portion and a second head portion connected and movable relative to the first head portion;

an elongate handle having a first end pivotally attached to the head at the first head portion, and a second end opposite the first end, the second end manually engageable to move the head along the floor;

a reservoir containing floor finish supported on the handle;

a pad coupled to the head and positioned between the head and the floor to receive floor finish from the reservoir, the pad including a first pad portion coupled to the first head portion and a second pad portion coupled to the second head portion such that the second head portion applies a substantially constant force on the floor independent of a force applied to the first head portion via the handle.

11. The floor finish application tool of claim 10, wherein the first pad portion is composed of a first material having an open cell structure to substantially evenly distribute floor finish on the floor, and a second pad portion composed of a second material that is finer than the first material to smooth the evenly distributed floor finish.

12. The floor finish application tool of claim 10, further comprising a length of tubing coupled to the reservoir and extending toward the head for conveying floor finish from the reservoir to the floor, the reservoir and tubing removable from the floor finish application tool and replaceable when the floor finish within the reservoir is depleted.

13. The floor finish application tool of claim 10, further comprising a sleeve coupled to the handle, the sleeve shaped and configured to receive at least a portion of the reservoir and selectively couple the reservoir to the handle.

14. The floor finish application tool of claim 10, wherein the reservoir includes an elongated recess dimensioned to receive the handle substantially within the recess, such that the weight of the floor finish within the container is distributed around substantially an entire circumference of the handle.

15. The floor finish application tool of claim 10, wherein the reservoir and the tubing are removed as a single assembly.

16. The floor finish application tool of claim 10, further comprising a hinge connecting the second head portion to the first head portion such that the second head portion floats relative to the first head portion.

* * * * *